US007785709B2

(12) United States Patent
Ding

(10) Patent No.: US 7,785,709 B2
(45) Date of Patent: Aug. 31, 2010

(54) SPINNING POLY(TRIMETHYLENE TEREPHTHALATE) YARNS

(75) Inventor: Zhuomin Ding, Blythewood, SC (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 44 days.

(21) Appl. No.: 12/357,424

(22) Filed: Jan. 22, 2009

(65) Prior Publication Data

US 2009/0130354 A1 May 21, 2009

Related U.S. Application Data

(62) Division of application No. 10/836,568, filed on Apr. 30, 2004.

(51) Int. Cl.
*D02G 3/00* (2006.01)

(52) U.S. Cl. ..... 428/364; 428/395; 428/36.3; 206/392

(58) Field of Classification Search ..... 428/364, 428/395, 36.3; 206/392
See application file for complete search history.

(56) References Cited

U.S. PATENT DOCUMENTS

| | | | | |
|---|---|---|---|---|
| 4,923,662 | A | 5/1990 | Kurita et al. | |
| 6,284,370 | B1 | 9/2001 | Fujimoto et al. | |
| 6,312,805 | B1 | 11/2001 | Sun | |
| 6,353,062 | B1 | 3/2002 | Giardino et al. | |
| 6,538,076 | B2 | 3/2003 | Giardino et al. | |
| 6,682,815 | B2 * | 1/2004 | Koyanagi et al. | 428/364 |
| 2002/0119311 | A1 | 8/2002 | Fujimoto et al. | |
| 2002/0132962 | A1 | 9/2002 | Giardino et al. | |
| 2003/0220465 | A1 | 11/2003 | Giardino et al. | |
| 2004/0151904 | A1 * | 8/2004 | Ding et al. | 428/373 |
| 2005/0244636 | A1 * | 11/2005 | Ding | 428/364 |
| 2009/0130354 | A1 * | 5/2009 | Ding | 428/36.3 |

FOREIGN PATENT DOCUMENTS

| | | | |
|---|---|---|---|
| EP | 0998440 | | 5/2000 |
| EP | 1 033 422 | A1 | 9/2000 |
| EP | 1 275 758 | A1 | 1/2003 |
| EP | 1 300 356 | A1 | 4/2003 |
| JP | 99172526 | | 6/1999 |
| JP | 99302919 | | 11/1999 |
| WO | WO98/57913 | | 12/1998 |
| WO | WO00/14041 | | 3/2000 |
| WO | WO00/58393 | | 10/2000 |
| WO | WO01/09069 | | 2/2001 |
| WO | WO01/09073 | | 2/2001 |
| WO | WO01/14450 | | 3/2001 |
| WO | WO01/34693 | | 5/2001 |
| WO | WO01/58981 | | 8/2001 |
| WO | WO 03/071013 | A1 | 8/2003 |

OTHER PUBLICATIONS

International Search Report dated Sep. 20, 2005 (6 pgs.).
H.L. Traub, "Synthesis and Textile Chemistry Properties of Polytrimethyleneterephthalate", Dissertation Universitat Stuttgart (Feb. 1994)).
S. Schauhoff, "New Developments in the Production of Polytrimethylene terephthalate (PTT)". Man-Made Fiber Year Book (Sep. 1996), pp. 8-10.

* cited by examiner

*Primary Examiner*—N. Edwards

(57) ABSTRACT

A novel process is provided for making spin-drawn yarn from poly(trimethylene terephthalate). The yarn, when packaged on a cheese-shaped spindle, can be produced in large sizes without crushing.

30 Claims, 2 Drawing Sheets

SPINNING POLY(TRIMETHYLENE TEREPHTHALATE) YARNS

CROSS-REFERENCE TO RELATED APPLICATION

This application is a divisional of U.S. application Ser. No. 10/836,568, filed on Apr. 30, 2004, the content of which is hereby incorporated by reference in its entirety.

FIELD OF THE INVENTION

This invention relates to a process for spinning poly(trimethylene terephthalate) to make fibers suitable for textile and other applications, and to the product of this process, wherein the fibers have an acceptable amount of thermal shrinkage during and after spinning and further processing.

BACKGROUND

Poly(ethylene terephthalate) ("2GT") and poly(butylene terephthalate) ("4GT"), generally referred to as "polyalkylene terephthalates", are common commercial polyesters. Polyalkylene terephthalates have excellent physical and chemical properties, in particular chemical, heat and light stability, high melting points and high strength. As a result they have been widely used for resins, films and fibers.

Poly(trimethylene terephthalate) ("3GT") has achieved growing commercial interest as a fiber because of the recent developments in lower cost routes to 1,3-propane diol (PDO), one of the polymer backbone monomer components. 3GT has long been desirable in fiber form for its disperse dyeability at atmospheric pressure, low bending modulus, elastic recovery and resilience.

Spinning and drawing the 3GT filament may be carried out continuously in a single combined operation. The yarn produced by such a process may be referred to as spin-draw yarn (SDY). However the yarn so produced has a tendency to shrink on the tube on which it is wound, causing a heavy bulge in the yarn package, or even crushing the tube. This problem is more severe when larger packages of yarn are made, such as packages containing more than about 4 kg of yarn, and when the spinning speed is greater than about 3500 m/min. As a result of tube crushing, the yarn packages are stuck on the spindles on the winder, and can not be readily removed. In some embodiments, e.g., in some multifilament yarns, the yarn has an IV from about 0.7 to about 1.1.

Several solutions have been proposed. For example, when winding a small package, the shrinkage force can be reduced, because much fewer yarn layers are wound on the tube. However, packaging with small packages becomes uneconomical. The use of a thicker and stronger tube creates an unacceptably heavy package even when the package size is small, and is inadequate in strength when the package size is large.

It is also well known that the use of a slow spinning speed in a spin-draw process minimizes this problem, and improves the bulge or windup tube crushing. When a low spinning speed is applied, the low speed allows a high overfeed between the draw roll and windup in a two godet process, or a high overfeed between the second and third godet in a three godet process. Together with the large overfeed, the low speed allows more time to relax the filaments during spinning. However, the low spinning speed results in low productivity and the process becomes uneconomical.

Japanese Kokai JP 9339502 discloses a spin-draw process for 3GT in which the extruded fiber is wound on a first roller at 300-3500 m/min. and 30-60° C., stretched to 1.3 to 4 times its length through a second roller at 100-160° C., and then wound and cooled on a third roller. However, this technology could not make packages with a weight of more than 2 kg, as pointed out in subsequent patent JP 99302919.

U.S. Pat. No. 6,284,370 discloses a spin-draw process for 3GT so as to obtain a cheese-like package. The molten multifilament enters a holdup zone at 30-200° C. to solidify the filaments. It then passes the first godet which is heated at 30-80° C. at a speed of 300-3500 m/min, is drawn at a draw ratio of 1.3-4 to a second godet at 100-160° C., before being wound into a package at a slower winding speed. The winding tension is preferably between 0.05 and 0.4 gram/denier. In two examples (Examples 11 and 12), the filaments are cooled on a third godet. Neither example shows a high spinning speed in combination with a suitable third godet overfeed. Package sizes ranged from 1 to 5 kg.

Japanese Kokai JP 99302919, by co-applicants to U.S. Pat. No. 6,284,370, discloses a similar process. After the molten 3GT multifilament is extruded and solidified as before, it passes the first godet which is heated at 40-70° C. at a speed of 300-3000 m/min, is drawn at a draw ratio of 1.5-3 to a second godet at 120-160° C., and is cooled down before being wound into a package at a slower winding speed. This final cooling was done by cooling on a third godet (Example 1), or by applying cold water (Example 3). The second and third godets were run at the same speed, i.e., with no third godet overfeed. The winding tension, although important, was not disclosed. Package sizes were up to 6 kg.

The above processes are limited in package size and winding speed. There is a need for a spin-draw process which enables spinning 3GT fibers at a speed of 4000 m/min or more at the second godet into a cheese-like package containing over 6 kg of fiber.

SUMMARY OF THE INVENTION

According to a first aspect, a process comprises spin-drawing yarn wherein:

(a) molten poly(trimethylene terephthalate) is continuously spun into solid filaments, (b) the solid filaments are wound onto a first godet, (c) the solid filaments are wound onto a second godet, (d) the solid filaments are wound onto a third godet, and (e) the solid filaments are wound onto a spindle on a winder to form a package, wherein the filaments are overfed onto the third godet and the winding tension between the third godet and the spindle is 0.04 to 0.12 gram per denier. Preferably, the filaments are overfed by 0.8 to 2.0% relative to the speed of the second godet.

According to another aspect, the second godet has a higher peripheral speed than the first godet. Preferably, the peripheral speed of the second godet is 4000 meters per minute or higher. In some preferred embodiments, the peripheral speed of the second godet is 4800 meters per minute or higher, e.g. about 5200 or higher.

According to another aspect, the draw ratio between the first godet and the second godet is 1.1-2.0.

According to another aspect, the peripheral speed of the third godet is below the peripheral speed of the second godet.

According to yet another aspect, the filaments are overfed to the spindle. Preferably, the filaments are wound onto the spindle on the winder such that the third godet speed overfeeds the true yarn speed at the winder by 1.5 to 2.5%.

According to a further aspect, a process comprises (a). providing poly(trimethylene terephthalate) having an IV of 0.7 deciliters per gram or higher, (b). extruding the poly(trimethylene terephthalate) through a spinneret at a temperature of about 245° to about 285° C., (c). cooling the poly(trimethylene terephthalate) to a solid state in a cooling zone to form filaments, (d). interlacing the filaments, (e) winding the filaments onto a first godet having a temperature of about 85 to about 160° C. at a peripheral speed of about 2600 to about 4,000 m/min, (f). winding the filaments onto a second godet heated to about 125 to about 195° C., at a peripheral speed higher than that of the first godet whereby the filaments are drawn at a draw ratio of about 1.1 to about 2.0 between the first and second godet;

(g). winding the filaments onto a third godet having a peripheral speed below that of the second godet so that the filaments are overfed by about 0.8 to about 2.0% relative to the speed of the second godet, and (h). winding the filaments onto a spindle on a winder having a peripheral speed below that of the third godet, whereby the filaments are wound onto the spindle on the winder such that the third godet speed overfeeds the true yarn speed at the winder by 1.5 to 2.5%, and wherein the winding tension between the third godet and the winder is between about 0.04 and about 0.12 gram per denier.

Preferably, the third godet is not heated. Generally, the third godet will be at ambient temperature, e.g., about 15 to 30° C.

According to a further aspect, a poly(trimethylene terephthalate) multifilament yarn has the following properties:

(a). shrinkage onset temperature of above 63.2° C., (b). a shrinkage at 70° C. of below 1.2%, (c). a peak thermal tension of below 0.2 g/d, and (d). a thermal tension slope at 110° C. greater than $5.20\times 10^{-04}$ [g/(d ° C.)].

Preferably, the multifilament yarn has an elongation of about 25 to about 60%, more preferably about 30 to about 60%. Also preferably, the multifilament yarn has a tenacity of at least about 3.0 g/d. Also preferably, the yarn has a BOS of 6-14% and/or an Uster of 1.5% or less.

The multifilament yarn also preferably has a denier of about 40 to about 300. Denier per filament is preferably from about 0.5 to about 10.

According to another aspect, the multifilament yarn comprises a cheese-shaped package. The term "cheese-shaped" is understood by those skilled in the art to refer to a three-dimensional shape that is substantially cylindrical, as opposed to conical, with slightly bulging sides, as illustrated in FIG. 2. Preferably, the cheese-shaped package does not crush upon standing for four days, e.g, about 96 hours after the yarn is wound on the package.

According to yet another aspect, a cheese-shaped package contains at least 6 kilograms (kg) of poly(trimethylene terepthalate) multifilament yarn and has a bulge ratio of less than about 10%.

DETAILED DESCRIPTION

Unless stated otherwise, all percentages, parts, ratios, etc., are by weight. All patents, patent applications, and publications referred to herein are incorporated by reference in their entirety.

When an amount, concentration, or other value or parameter is given as either a range, preferred range or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

According to a first aspect, (a). molten poly(trimethylene terephthalate) is continuously spun into solid filaments, (b). the solid filaments are wound onto a first godet, (c). the filaments are wound onto a second godet, (d). the filaments are wound onto a third godet, and (e). the filaments are wound onto a spindle on a winder to form a package, wherein the filaments are overfed onto the third godet and the winding tension between the third godet and the spindle is 0.04 to 0.12 gram per denier.

Figure 1:
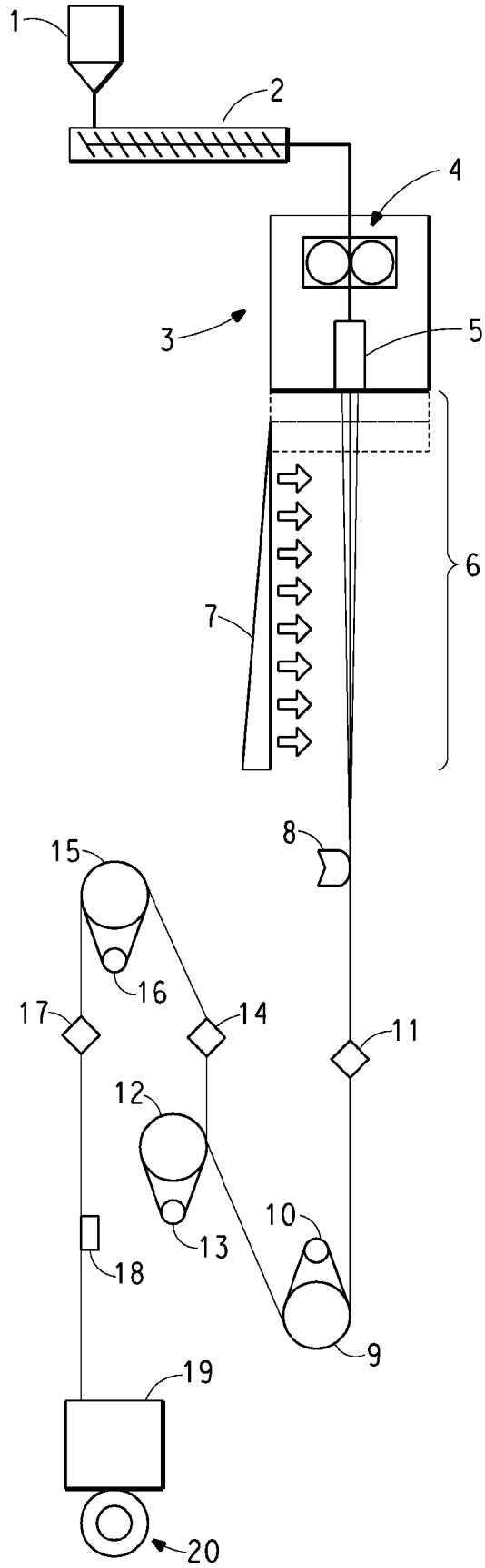
FIG. 1 illustrates an exemplary process and device for making a yarn.

An exemplary embodiment of the invention is shown in FIG. 1. However, this is meant to be only illustrative, and should not be construed as limiting the scope of the invention. Variations will be readily appreciated by those skilled in the art. Poly(trimethylene terephthalate) polymer is supplied to hopper 1, which feeds the polymer to extruder 2 into spinning block 3. Spinning block 3 contains spinning pump 4 and spinning pack 5. Polymer threadline 6 exits the spinning block 3 and is quenched 7 with air. A finish is applied to threadline 6 at finish applicator 8, then passes via interlace jet 11. Threadline 6 passes to the first heated godet 9, with its separator roll 10. Threadline 6 passes to second heated godet 12 with separator roll 13 then to interlace jet 14 and third godet 15 and separator roll 16. Threadline 6 then passes to interlace jet 17 and through fanning guide 18 to winder 19 onto package 20.

Poly(trimethylene terephthalate) useful in this invention may be produced by known manufacturing techniques (batch, continuous, etc.), such as described in U.S. Pat. Nos. 5,015,789, 5,276,201, 5,284,979, 5,334,778, 5,364,984, 5,364,987, 5,391,263, 5,434,239, 5,510,454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745, 5,990,265, 6,140,543, 6,245,844, 6,066,714, 6,255,442, 6,281,325 and 6,277,289, EP 998 440, WO 98/57913, 00/58393, 01/09073, 01/09069, 01/34693, 00/14041 and 01/14450, H. L. Traub, "Synthese und textilchemische Eigenschaften des Poly-Trimethylene-terephthalats", Dissertation Universitat Stuttgart (1994), S. Schauhoff, "New Developments in the Production of Poly (trimethylene terephthalate) (PTT)", Man-Made Fiber Year Book (September 1996), and U.S. patent application Ser. Nos. 09/501,700, 09/502,322, 09/502,642 and 09/503,599, all of which are incorporated herein by reference. Poly(trimethylene terephthalate)s useful as the polyester of this invention are commercially available from E.I. du Pont de Nemours and Company, Wilmington, Del. under the trademark "Sorona".

The poly(trimethylene terephthalate) (3GT) polymer, preferably, has an intrinsic viscosity (IV) of 0.7 or higher deciliters/gram (dl/g) or higher, preferably 0.9 dl/g or higher, more preferably 1.0 dl/g or higher. Although it is generally desirable to have a high IV, for some applications the polymer IV is about 1.4 or less, even about 1.2 dl/g or less, and in some embodiments, can be 1.1 dl/g or less. Poly(trimethylene terephthalate) homopolymers particularly useful in practicing this invention have a melting point of about 225 to about 231° C.

Typically the 3GT is available as a flaked material. Preferably, the flakes are dried in a typical flake drying system for polyester. Preferably, the moisture content after drying will be about 40 ppm (parts per million) or less.

Preferably, spinning can be carried out using conventional techniques and equipment described in the art with respect to polyester fibers, with preferred approaches described herein. The spinneret hole size, arrangement and number will depend on the desired fiber and spinning equipment. The spinning temperature is, preferably, from about 245 to about 285° C. More preferably, the spinning temperature is from about 255 to about 285° C. Most preferably the spinning is carried out at about 260 to about 270° C.

The molten filament is then cooled to become solid state filaments in a cooling zone. Cooling can be carried out in a conventional manner, preferably using a cross-flow quench zone using air or other fluids described in the art (e.g., nitrogen). Preferably the apparatus used has a quench delay zone 50 to 150 mm long from the spinneret to the beginning of the quench zone, more preferably about 60 to 90 mm in length. The quench delay allows the filaments to be cooled down gradually and with a controlled attenuation region. Preferably, the temperature of the quench delay zone is in the range of about 50 to about 250° C. The quench delay zone may be heated or unheated. For better control of the cooling process, this zone is preferably well sealed so that no extraneous air is allowed to leak to the filament bundle, and is designed to prevent air turbulence and irregular air-flow. Alternatively, radial, asymmetric or other known quenching techniques can be used for final cooling.

Spinning finishes are, preferably, applied at any appropriate time after cooling using conventional techniques. The spinning finish may be applied at one time by a single application before the first godet, or a second finish may be applied between the second and third godet, or between the third godet and the winder. The arrangement of the godets are described in detail below.

The filaments are then wound onto a first godet having a preferred peripheral speed of 2600 to 4000 meters per minute (m/min) and a preferred temperature of about 85 to about 160° C. More preferably, the speed of the first godet is about 3000 to 3500 m/min. Speeds of the first godet lower than 2600 m/min may result in an undesirably low productivity for some applications, because of limitations from the required subsequent draw ratio. In some embodiments, it is preferred that the peripheral speed of the first godet can be as high as about 4700, 4800 or higher.

Preferably, the filaments make 4 to 6 turns around the first godet/separator roll combination. As used herein, unless stated otherwise the expression "turns around the first godet" or "turns around the second godet", or "turns around the third godet" is intended to mean turns around the respective godet/separator roll combination. Fewer than 4 turns may permit slippage of filament and prevent the filament from being properly drawn.

The filaments are then wound onto a second godet. The second godet has a higher peripheral speed than that of the first godet whereby the filaments are drawn at a draw ratio of 1.1 to 2.0 between the first godet and the second godet. Preferably the peripheral speed of the second godet is 4000 m/min or higher. In some preferred embodiments the peripheral speed of the second godet can be 4800 m/min or higher.

The selection of draw ratio is determined by the desired elongation of the resultant yarn. There are two major factors that could affect the selection of draw ratio at a given elongation: polymer IV and spinning speed. At a given elongation, the higher the polymer IV, the lower the draw ratio required. The higher the spinning speed, the lower the draw ratio required at given elongation and polymer IV.

The second godet temperature is, preferably, about 125 to about 195° C., more preferably, about 145 to about 195° C.

The filaments are next wound onto a third godet having a peripheral speed below that of the second godet so that the filaments are overfed by 0.8 to 2.0% relative to the speed of the second godet. An overfeed of less than 0.8% is not enough to relax enough orientation to avoid tube crush winding or bulge. An overfeed of at least 0.8% allows the threadline between the second and third godets to be relaxed sufficiently to give stable filaments that would otherwise contract on the winding tube, causing the winding to crush the tube on the spindle on a winder if more than a small amount of filament is wound. Preferably, the filaments are overfed by 1.0 to 2.0% relative to the speed of the second godet. The amount of overfeed is controlled below 2.0% to prevent threadline slippage on the second godet, making the spinning process more stable and avoiding spinning breaks. The instability leads to a non-uniform yarn property along the fiber and possible spinning breaks.

The third godet functions in part to cool the filament, which allows a higher overfeed between the second godet and winder, and provides a longer time for the filament to relax between the second godet and winder. The third godet is thus preferably not heated or cooled. By "not heated" is meant that no attempt is made, e.g., by the supplying of thermal energy to the godet, to raise its temperature above the ambient temperature. Although a reinforced chilling mechanism may be desirable at the third godet to achieve a lower temperature, the absence of any external cooling will generally allow adequate cooling of the threadline before winding. Optionally, an interlace jet and/or a finish applicator can be installed between the second godet and third godet, or between the third godet and the winder, or can replace the third godet.

Finally, the filaments are wound onto a spindle on a winder having a peripheral speed such that the third godet speed overfeeds the true yarn speed at the winder by 1.5 to 2.5%. A conventional winder is used wherein the rotational speed is varied as the yarn package diameter increases so as to maintain a constant yarn surface linear speed. Because the yarn traverses the winder in a helix while being wound, the true yarn speed is higher than that of the winder itself. This slight difference in speed is very significant when dealing with such low percentage overfeeds.

True yarn speed is provided by the following equation:

$$\text{True yarn speed} = \frac{SP(WU)}{\cos(HA)}$$

wherein SP(WU) is the windup speed, cos is the cosine and HA is the winding helix angle. The helix angle is the angle between the plane containing package end surface and the threadline that is leaving the plane.

In addition to controlling the overfeed between the second godet and third godet, a low winding tension is used to avoid windup tube crushing. A proper winding tension allows the properly selected third godet overfeed and second godet temperature to be effective for optimum relaxation during spinning, while an excessive high or low winding tension will prevent a proper package winding. Preferably the winding tension is 0.04 to 0.12 grams per denier (g/d). More preferably the winding tension is 0.05 to 0.10 g/d. Still more preferably the winding tension is 0.06 to 0.09 g/d. Winding tension is a function of not only the winder overfeed, but also the filament properties at this stage. However, since the filament properties are already largely determined at this stage of the process, the winding tension may be controlled by varying the winding overfeed within the previously disclosed ranges. The winding tension is measured in the threadline fanning zone which is between the last guide contact point on the third godet and the first contact point (the touch roll), on the winder.

The winding tension is controlled by a windup overfeed, according to the equation:

$$OvFd(WU) = 100\% \times \frac{SP(G3) - TYS}{SP(G3)} \quad \text{(II)}$$

wherein OvFd (WU) is the windup overfeed; SP(G3) is the spinning speed of the third godet, and TYS is the true yarn speed as defined above.

As is known to those skilled in the art, tube crush winding refers to a yarn wound in a package, which crushes the tube core carrying the yarn. This can result in deformation of the package, for example, by bulging or other deformations. While tube crush winding may be caused by high winding tension only, in 3GT SDY spinning the tube crush winding often occurs at normal winding tension because of factors specific to 3GT's properties. For 3GT, tube crush winding is typically caused by shrinkage of yarn on the package.

After filaments are properly wound into a package at proper winding tension, if the yarn has a stable structure, the package formation will remain. If the molecules in the yarn in the package disorient at the ambient temperature, the yarn starts to shrink. The shrinking yarn generates high shrinkage tension that could crush the tube and or cause heavy bulge during the time frame of package winding. In order to effectively reduce winding tension, several turns should be made on the third godet to prevent threadline slippage on the third godet.

The wound fiber package may be removed from the winder when full. Preferably, the package weight is above 6 kg.

Meaningful measurements of yarn properties require a standardized measurement procedure, preferably after the yarn properties have leveled out. While it may be desirable to measure these properties at a lag time corresponding to the actual shrinkage on the tube, this period is so short as to pose a number of practical difficulties. Generally, a 4 day (96 hour) lag time after storage at ambient temperature is suitable. Lag time refers to the time after doffing the tube and before testing.

According to another aspect, poly(trimethylene terephthalate) multifilament yarn has the following properties:

(a). a shrinkage onset temperature of at least about 60° C.;

(b). a shrinkage at 70° C. of below 1.2%;

(c). a peak thermal tension of below 0.2 g/d, and (d). a thermal tension slope at 110° C. greater than $5.20\times10^{-04}$ [g/(d ° C.)].

The properties are measured, after storage at 20-25° C. for 4 days, preferably 96 hours, by the methods listed under "Test Methods".

The shrinkage onset temperature is preferably above 63° C. The shrinkage onset temperature (Ton) describes the starting point of yarn shrinkage. It is generally preferred that the shrinkage onset temperature be as high as possible; the practical upper limit may be limited by the amount of crystallinity in the fiber and may be, for example, about 70° C.

The shrinkage at 70° C. correlates closely with the shrinkage at ambient temperatures, the primary cause of tube crush winding. The shrinkage is preferably less than about 1.2% for packaging performance, and in some embodiments can be close to zero, e.g., about 0.1% or even lower. The shrinkage can be obtained from the shrinkage-temperature curve The peak thermal tension is a measure of the crushing strength of the fiber, and is preferably below 0.2 g/d for satisfactory packaging performance.

The thermal tension slope at 110° C. can be obtained from the tension-temperature curve. This parameter is the slope of the linear regressive equation from data points from 100-115° C., although it is called the slope at 110° C. The parameter is abbreviated as TS(110), representing the tension slope at 110° C. on the tension-temperature curve. A thermal tension slope at 110° C. greater than $5.20\times10^{-04}$ [g/(d ° C.)] is an indication of a yarn that was packaged at a satisfactory moderate temperature. Lower thermal tension slopes can indicate that the yarn was packaged at a high temperature, which can cause excessive shrinkage.

Preferably, the multifilament yarn has an elongation of about 25 to about 60%. Preferably, the yarn has a tenacity of at least about 3.0 g/d. Also preferably, the yarn has a BOS of about 6 to about 14%. Further, preferably, the yarn has an Uster value (uniformity measurement) of about 1.5% or less. Also preferably, the yarn has a thermal tension peak temperature of about 140 to about 200° C.

Generally, the process can be used to manufacture yarns of total denier from about 40 to about 300, and denier per filament (dpf) of about 0.5 to about 10.

According to another aspect a cheese-shaped package comprises the multifilament yarn in accordance with the present invention. Preferably, the package contains at least 7 kg of multifilament yarn and has a bulge ratio of less than 10% when the thickness of yarn layer is from about 49 to about 107 millimeters. More preferably, the yarn has a bulge ratio of less than 6% when the thickness of yarn layer is from about 25 to about 49 millimeters. Preferably, the package has a dish ratio of less than 2%. Preferably, the package does not crush upon standing for 96 hours after the yarn is wound on the package.

According to a further aspect, a cheese-shaped package contains at least 6 kg of poly(trimethylene terephthalate) multifilament yarn and has a bulge ratio of less than 10%. Preferably, the package weighs more than 6 kg. More preferably, the package weighs at least 9 kg. In some preferred embodiments, the cheese-shaped package containing the multifilament yarn contains 6 kg to about 8 kg and a height of 100 to 260 mm and has a bulge ratio of less than about 10%.

According to a further aspect, the cheese-shaped package contains 7 to about 25 kg of poly(trimethylene terephthalate) multifilament yarn. Preferably, the package contains 7 to 20 kg of poly(trimethylene terephthalate) multifilament yarn.

Multifilament yarns prepared according to the processes can be used, for example, in knitted and woven fabrics, hosiery, carpet and upholstery.

The 3GT fibers, preferably, contain at least 85 weight %, more preferably 90 weight % and even more preferably at least 95 weight % poly(trimethylene terephthalate) polymer. The most preferred polymers contain substantially all poly (trimethylene terephthalate) polymer and the additives used in poly(trimethylene terephthalate) fibers. (Additives include antioxidants, stabilizers (e.g., UV stabilizers), delusterants (e.g., $TiO_2$, zinc sulfide or zinc oxide), pigments (e.g., $TiO_2$, etc.), flame retardants, antistats, dyes, fillers (such as calcium carbonate), antimicrobial agents, antistatic agents, optical brighteners, extenders, processing aids and other compounds that enhance the manufacturing processability and/or performance of poly(trimethylene terephthalate).

The fibers are monocomponent fibers. (Thus, specifically excluded are bicomponent and multicomponent fibers, such as sheath core or side-by-side fibers made of two different types of polymers or two of the same polymer having different characteristics in each region, but not excluded are other polymers being dispersed in the fiber and additives being present.) They may be solid, hollow or multi-hollow. Round or other fibers (e.g., octalobal, sunburst (also known as sol), scalloped oval, trilobal, tetra-channel (also known as quatra-channel), scalloped ribbon, ribbon, starburst, etc.) can be prepared.

Test Methods

Tenacity and Elongation

The physical properties of the yarns reported in the following examples were measured using an Instron Corp. tensile tester, model no. 1122. More specifically, elongation to break (EB), and tenacity were measured according to ASTM D-2256.

Uster

An Uster Tester 3, Type UT3-EC3 manufactured by ZELLWEGER USTER was used. The Usters were measured according to ASTM D-1425. The mean deviation of unevenness, U %, Normal value, was obtained at strand speed=200 m/min, test time=2.5 minutes.

Boil Off Shrinkage

Boil off shrinkage ("BOS") was determined according to ASTM D 2259 as follows: A weight was suspended from a length of yarn to produce a 0.2 g/d (0.18 dN/tex) load on the yarn and then length $L_1$ was measured. The weight was then removed and the yarn was immersed in boiling water for 30 minutes. The yarn was then removed from the boiling water, centrifuged for about a minute and allowed to cool for about 5 minutes. The cooled yarn is then loaded with the same weight as before. The new length of the yarn, $L_2$, was measured. The percent shrinkage was then calculated according to equation:

$$\text{Shrinkage (\%)} = \frac{L_1 - L_2}{L_1} \times 100$$

Dry Warm Shrinkage

Dry Warm Shrinkage ("DWS") was determined according to ASTM D 2259 substantially as described above for BOS. $L_1$ was measured as described. However, instead of being immersed in boiling water, the yarn was placed in an oven at about 45° C. After 120 minutes, the yarn was removed from the oven and allowed to cool for about 15 minutes before $L_2$was measured. The percent shrinkage was then calculated according to equation (III), above.

The DWS was developed to better evaluate the yarn shrinkage at ambient temperature, which can cause package winding problems. The shrinking of SDY is highly time dependent, so it is preferred to measure DWS at a fixed period after removal of the package.

The measurement of DWS allows the determination of aging resistance of a 3GT spun yarn by exposing a length of yarn to conditions wherein the yarn reaches at least 85%, preferably 95%, of its equilibrium shrinkage and measuring the shrinkage of the yarn. DWS measurement is further described in U.S. patent application Ser. No. 10/663,295 filed Sep. 16, 2003, the disclosures of which are hereby incorporated herein by reference in their entirety. The heating temperature may be from about 30 to about 90° C., preferably, about 38 to about 52° C., and more preferably about 42 to about 48° C. The heating time at a given heating temperature in the DWS measurement is therefore:

$$\text{Heating_Time} \geqq 1.561 \times 10^{10} \times e^{-0.4482[\text{Heating_Temperature}]}$$

The preferred heating time is:

$$\text{Heating_Time} \geqq 1.993 \times 10^{12} \times e^{-0.5330[\text{Heating_Temperature}]}$$

where the heating time is in minutes and the heating temperature is in degrees Celsius. For example, at a heating temperature of 41° C., the sample heating time is to be greater than or equal to 163 minutes (2.72 hours), preferably 644 minutes (10.73 hours). If at a sample heating temperature of 45° C., the sample heating time is to be greater than or equal to 27.2 minutes (0.45 hours), preferably 76.4 minutes (1.27 hours). For purposes of the present invention, measurements should be taken after exposing the yarn to 41° C. for at least 24 hours to determine equilibrium shrinkage.

The yarn used for DWS measurement may be skein or non-loop yarn. A skein may be single loop or multiple loop, wherein the loop may be single or multiple filament. A non-loop yarn sample may contain multiple yarns or a single yarn, wherein the yarn may be single or multiple filaments.

The sample length (L1 before heating and L2 after heating) is defined as the skein length that is half of the yarn length that makes a single loop in the skein. The sample length may be any length that is practically measurable, before and after heating. The length of a sample for measurement, L1, is typically in the range of about 10 to 1000 mm, preferably, about 50 to 700 mm. A length, L1, of about 100 mm may be conveniently used for the sample in the form of a single loop skein, and L1 of about 500 mm for the sample in the form of a multi-loop skein.

In this method, a tensioning weight is suspended from the sample of yarn to keep straight the sample to measure the length, L1. The yarn is typically made into a loop by knotting the ends. The length, L1, is measured at ambient temperature with the tensioning weight hanging on the loop. The tensioning weight is preferably at least sufficient to keep the sample straight, but not cause the sample to stretch. A preferred tensioning weight for a sample yarn can be calculated according to the following:

$$\text{Tensioning Weight} = 0.1 \times 2 \times (\text{No. loops in a skein}) \times (\text{yarn denier})$$

Typically, the sample is coiled into a double loop and is hung on a rack. If hung on a rack, optionally, an applied weight may be suspended from the loop. The weight may be useful to steady the sample. The applied weight should neither limit contraction of the sample, nor cause stretch during heating. When no weight is applied, the sample may simply be placed on a surface where it is allowed to contract freely during heating.

Heating can be accomplished, for example, using a gaseous or liquid fluid. If a liquid is used, the yarn is placed in a vessel. An oven is conveniently used if the fluid is a gas, with the preferred gas being air. The sample should be placed in the heating fluid in a manner, which allows the sample to freely contract.

The sample is removed from heating and is cooled for at least about 15 minutes. The length of the heated sample is measured with the tensioning weight hung from the sample and recording this value as L2. DWS is calculated from L1 and L2 as follows $$DWS\ (\%) = \frac{L_1 - L_2}{L_1} \times 100$$

DWS corresponds to aging resistance of the yarn, as manifested, for example, by dish formation. DWS increases as dish ratio increases and thus correlates with dish formation. Commercial standards for filament spinning allow a diameter difference of ED−MD in a yarn package, 2.5 kg, 160 mm in diameter, of 2 mm. Therefore, if an aged yarn has a diameter difference of about 2 mm or less, the yarn generally has acceptable aging resistance per commercial standards.

In some embodiments, tube crush winding can be avoided if all of the following four conditions are met: That is, a package yarn with satisfactory characteristics preferably has the following properties, (1) a shrinkage onset temperature of above 63.2° C.

(2) a shrinkage at 70° C. of below 1.2%, or a DWS measurement below 1.0%

(3) a peak thermal tension of below 0.2 g/d (4) a thermal tension slope at 110° C. greater than 5.20×10-04 [g/(d*° C.)].

The above properties are generally measured after storage at 20-25° C. for 4 days.

Measurements Of Thermal Tension Versus Temperature

Measurement was carried out at a heating rate of 30° C./min using a shrinkage-tension-temperature measurement device produced by DuPont. The yarn sample is prepared as a loop from 200 mm of yarn, making the loop 100 mm long. The pre-tension applied in a tension-temperature measurement is 0.005 gram/denier, i.e., the pre-tension (grams)=yarn denier×2×0.005 (gram/denier).

An SDY tension-temperature curve shows a peak tension at a certain temperature. Three parameters may be determined: the shrinkage peak tension, peak temperature, and shrinkage onset temperature. The shrinkage peak tension is the height of the peak of the tension-temperature curve. The peak temperature is the location of the tension peak. The shrinkage onset temperature describes the starting point of the shrinkage. The shrinkage onset temperature is obtained by drawing a straight line through the rapid increment of shrinkage tension and drawing a straight line parallel to temperature axis and passing the minimum tension before the tension is rapidly increased. The temperature of the cross point of the two straight line is defined as the shrinkage onset temperature. This shrinkage onset temperature, and peak tension temperature and shrinkage peak tension are all affected by the heating rate applied in the test. When these parameters are compared for different samples, the heating rate should be the same.

Measurements Of Thermal Shrinkage Versus Temperature

The measurement of thermal shrinkage versus temperature was carried out using the same sample as prepared for thermal tension versus temperature measurement. The sample was loaded into the same sample chamber as for tension-temperature measurement. Tension-temperature and shrinkage-temperature should be run separately. Different from tension-temperature measurement, a constant tension, 0.018 g/d, was maintained during the shrinkage-temperature measurement. The variable measured in the shrinkage-temperature measurement is the shrinkage against temperature. A heating rate of 30° C./min was applied in the shrinkage-temperature measurement.

Dish Formation

Figure 2:
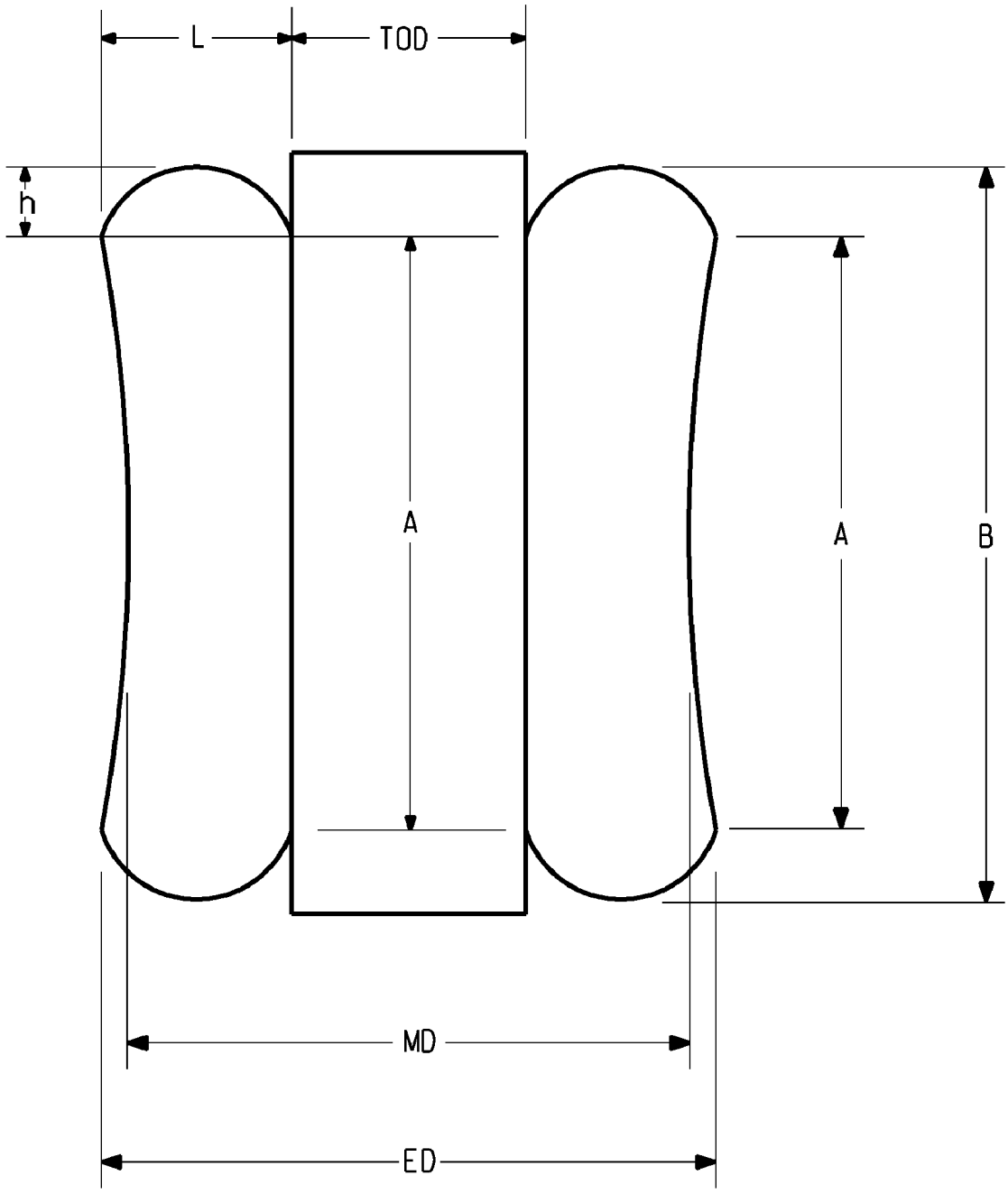
FIG. 2 provides a schematic illustration of a yarn package demonstrating bulge and dish deformation.

Dish formation, which is illustrated in FIG. 2, refers to the package deformation in the direction along the package radius wherein the yarn between the two package end surfaces contracts more than these near end surfaces so that package mid diameter is smaller than the end diameter. Dish deformation may be quantitatively described as a dish ratio per $$\text{Dish Ratio} = \frac{ED - MD}{A} \times 100\%$$

where ED is the diameter at the end of the package, "package end diameter"; MD is the diameter of the package in the middle of the package, "package mid diameter"; and A is the length of the package along the surface of the tube core.

Bulge Formation

Bulge, which is illustrated schematically in FIG. 2, is the deformation in the direction along the package length wherein the yarn expands in a vertical direction above the original end surface of the package. Bulge formation may be described quantitatively by a bulge ratio per equation:

$$\text{Bulge Ratio} = \frac{h}{L} \times 100\% = \frac{B - A}{ED - TOD} \times 100\%$$

wherein h is the bulge height; L is the thickness of the yarn on the package; B is the maximum length of the yarn package; A is the length of the package along the surface of the tube core; ED is the diameter at the end of the package, "package end diameter"; TOD is the tube outside diameter. Bulge height, h, has the relationship in equation:

$$A+2h=B$$

The thickness of the yarn layer of a package, "L", has the relationship in equation:

$$TOD+2L=\text{ED}$$

It should be noted that the calculation for bulge ratio includes the impact of the package diameter through the thickness of yarn layer. Therefore, a small diameter package could make a significant bulge appear to be small. Bulge formation can develop during package winding or during yarn storage.

EXAMPLES

The following examples are presented for the purpose of illustrating the invention, and are not intended to be limiting.

Example 1

In Example 1, 3GT flakes with an I.V. of 1.02 were dried in a flake drying system for polyester. The dried flakes, having moisture contents of 40 ppm or below, were fed into an extruder for remelting, then transferred to a spinning block and extruded from spinnerets. The spinneret had 34 holes, each with a diameter of 0.254 mm. The molten polymer streams coming out of the spinnerets were cooled by quench air into solid filaments. They first entered an unheated quench delay zone 70 mm in length, followed by a cross flow quench air zone. After being applied with a finish, the filaments entered a drawing system of three godets. All three godets had the same diameter of 190 mm. The filaments were heated by the first godet at temperature of 90° C. at a speed of 3334 m/min. The filaments made 5 turns on the first godet/separator roll combination. The second godet speed was considered the spinning speed, and was 4001 m/min. Unless otherwise specified, the spinning speed was at this value in all of the following examples. After being drawn between the first and second godet at a draw ratio of 1.3, the filaments were heat-set on the second godet, which was at temperature of 155° C. The filaments made 7 turns on the second godet/separator roll combination. The set filaments were allowed to be relaxed between the second and third godet by a third godet overfeed OvFd (G3)=1.3%. The third godet overfeed is defined as 100%×[SP(G2)−SP(G3)]/SP(G2), where SP (G2) is the second godet speed and SP(G3) is the third godet speed. The filaments made 4 turns on the third godet/separator roll. The third godet was unheated. The winding tension was controlled at 0.07 g/d by a windup overfeed of 2.32%. The tube core used had the following specifications:

| | |
|---|---|
| Tube core Length | 300 mm |
| Winding stroke | 257 mm |
| Tube core outside diameter: | 110 mm |
| Tube wall thickness: | 7 mm |

The process conditions of Example 1 are compared with other examples (Ex) or comparative examples (C.Ex) in Table 1A. The yarn properties obtained from Ex.1 are given in Table 1B.

Examples 2-5 and Comparative Examples 1-4

Examples 2, 3, 4 and 5 and Comparative Examples 1, 2, 3 and 4 were run at the same conditions as Example 1 except for the changes listed in Table 1A.

In Table 1A and succeeding tables, the following abbreviations apply:

4S5G for Turn(G1) means, for example, 4 half turns on separated roll and 5 half turns on first godet.

In C.Ex.1, Ex.1, Ex.2, and Ex.3, the first godet temperature varied from 75° C. to 115° C. The yarn properties of the examples are given in Table 1B. When the first godet temperature was at 75° C. in C.Ex.1, there were many spinning breaks during the test. When the first godet temperature was at 90° C., 102° C., or 115° C., the spinning ran well for Ex.1 to Ex.3, and there was no significant change in BOS, tenacity, elongation or U % (Table 1B). The tension peak, peak temperature and shrinkage onset temperature were measured before the time-dependence work was done, and were taken from the tube with lag time of about 1 day. Because of this, they can be compared only among themselves, not with the results obtained with different sample lag times. Table 1B shows that there is no significant difference in peak tension or shrinkage onset temperature due to changes in first godet temperature.

In C.Ex.2 to C.Ex.4, the first godet temperature was increased up to 150° C., with a second godet temperature of 145° C. and draw ratio of 1.3. Compared to Ex.1 to Ex.3, C.Ex.2 to C.Ex.4 used a third godet overfeed of 0.57, which gave tube crush winding for these comparative examples. As shown in Table 1B, there is no difference in tenacity or elongation between C.Ex.2 to C.Ex.4. The U % however increases slightly as temperature increased from 125° C. to 150° C. No significant difference in BOS was shown among C.Ex.2 to C.Ex.4, but it is significantly higher than the ones in Ex.1 to Ex.3.

The first godet temperatures in Exs.4 and 5 were 90° C. and 115° C. Compared to Exs.1, 2 and 3, the draw ratio was lower in Exs.1 and 2, but other conditions were the same. From Table 1B it can be seen that, when the first godet temperature increases from 90° C. to 115° C., the BOS tends to increase,

TABLE 1A

Spinning Conditions for the Effect of First Godet

| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. |
|---|---|---|---|---|---|---|---|---|---|---|
| C. Ex. 1 | 4s5g | 7S7G | 3S4G | 1.3 | 3077 | 3822 | 1.30 | 2.32 | 75 | 155 |
| Ex. 1 | 4s5g | 7S7G | 3S4G | 1.3 | 3077 | 3822 | 1.30 | 2.32 | 90 | 155 |
| Ex. 2 | 4s5g | 7S7G | 3S4G | 1.3 | 3077 | 3822 | 1.30 | 2.32 | 102 | 155 |
| Ex. 3 | 4s5g | 7S7G | 3S4G | 1.3 | 3077 | 3822 | 1.30 | 2.32 | 115 | 155 |
| C. Ex. 2 | 4s5g | 6S6G | 3S4G | 1.3 | 3077 | 3865 | 0.57 | 1.945 | 125 | 145 |
| C. Ex. 3 | 4s5g | 6S6G | 3S4G | 1.3 | 3077 | 3865 | 0.57 | 1.945 | 135 | 145 |
| C. Ex. 4 | 4s5g | 6S6G | 3S4G | 1.3 | 3077 | 3865 | 0.57 | 1.945 | 150 | 145 |
| Ex. 4 | 4s5g | 7S7G | 3S4G | 1.2 | 3334 | 3822 | 1.30 | 2.32 | 90 | 155 |
| Ex. 5 | 4s5g | 7S7G | 3S4G | 1.2 | 3334 | 3822 | 1.30 | 2.32 | 115 | 155 |

Temperature

In Table 1B and succeeding tables, the following abbreviations apply:

DWS=Dry Warm Shrinkage
BOS=Boil-Off Shrinkage
Den=Denier
Mod=Modulus of Elasticity
Ten=Tension
Elo=Elongation
% U=Uster (Normal)
T(p)=Shrinkage tension peak temperature
Tens(p)=Shrinkage peak tension
Ton=Shrinkage onset temperature

TABLE 1B

Yarn Properties from Spinning Conditions of Table 1A

| Ex. # | T4 g | DWS % | BOS % | Den | Mod g/d | Ten g/d | Elo % | % U % | Tp C. | Tens(Tp) g/d | Ton C. |
|---|---|---|---|---|---|---|---|---|---|---|---|
| C. Ex. 1 | — | Too many spinning breaks. | | | | | | | | | |
| Ex. 1 | 6.2 | 0.6 | 9.7 | 91.1 | 22.2 | 3.60 | 47.6 | 0.94 | 169.7 | 0.230 | 61.9 |
| Ex. 2 | 5.9 | 1.0 | 9.3 | 91.2 | 22.2 | 3.43 | 44.4 | 0.92 | 173.0 | 0.226 | 62.2 |
| Ex. 3 | 6.3 | 0.9 | 9.9 | 91.7 | 22.6 | 3.53 | 47.4 | 0.93 | 171.0 | 0.234 | 61.7 |
| C. Ex. 2 | 7.3 | — | 12.0 | 91.6 | — | 3.41 | 49.2 | 0.80 | — | — | — |
| C. Ex. 3 | 7.6 | — | 11.8 | 91.4 | — | 3.39 | 47.1 | 0.87 | — | — | — |
| C. Ex. 4 | 7.5 | — | 12.6 | 91.3 | — | 3.43 | 49.0 | 0.97 | — | — | — |
| Ex. 4 | 6.5 | 0.8 | 8.7 | 91.4 | 22.3 | 3.48 | 51.7 | 0.87 | 176.4 | 0.188 | 63.3 |
| Ex. 5 | 6.0 | 0.7 | 9.7 | 91.7 | 22.9 | 3.46 | 46.3 | 0.89 | 175.2 | 0.195 | 64.0 |

the elongation tends to decrease, the peak temperature tends to decrease, and the shrinkage onset temperature, or tension peak, tends to increase. The sample lag time for Exs.4 and 5 was about 1 day which is similar to the one for Exs.1, 2 and 3, therefore the peak temperature, tension peak and shrinkage onset temperature are comparable between the two sets of examples. The peak temperature, tension peak and shrinkage onset temperature of Exs.4 and 5 are higher than those of Exs.1, 2 and 3. These differences are attributed to the difference in the second godet temperature and draw ratio.

Examples 6-11 and Comparative Examples 5-7

These examples were run at the same conditions as Example 1 except for the changes listed in Table 2A. The yarn properties corresponding to the spinning conditions in Table 2A are given in Table 2B.

and DWS and BOS increased as shown in Table 2B. The sample lag time in Table 2B is similar to the one in Table 1B, that is the lag time was about one day. At low draw ratio among Exs.4, 1 and 6, the peak temperature was higher, the tension peak was lower, and the shrinkage onset temperature was higher than those at a high draw ratio. In Exs.5, 3 and 7, the same draw ratios were applied as in Exs.4, 1 and 6, but at a higher first godet temperature, 115° C. compared to 90° C. Results in Exs.5, 3 and 7 were similar to those in Exs.4, 1 and 6. However, when the draw ratio increased to 1.7 in C.Ex.5, it became difficult to string up the yarn. A draw ratio of 1.5 was applied in C.Exs.6 and 7 at a first godet temperature 125° C. The difference between C.Ex.6 and C.Ex.7 is that C.Ex.7 used a higher windup overfeed in order to reduce the winding tension. As indicated in Table 2B, there were many spinning

TABLE 2A

Spinning Conditions for the Effect of Draw Ratio

| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. |
|---|---|---|---|---|---|---|---|---|---|---|
| Ex. 4 | 4S5G | 7S7G | 3S4G | 1.2 | 3334 | 3822 | 1.30 | 2.32 | 90 | 155 |
| Ex. 1 | 4S5G | 7S7G | 3S4G | 1.3 | 3077 | 3822 | 1.30 | 2.32 | 90 | 155 |
| Ex. 6 | 4S5G | 7S7G | 3S4G | 1.4 | 2858 | 3822 | 1.30 | 2.32 | 90 | 155 |
| Ex. 5 | 4S5G | 7S7G | 3S4G | 1.2 | 3334 | 3822 | 1.30 | 2.32 | 115 | 155 |
| Ex. 3 | 4S5G | 7S7G | 3S4G | 1.3 | 3077 | 3822 | 1.30 | 2.32 | 115 | 155 |
| Ex. 7 | 4S5G | 7S7G | 3S4G | 1.4 | 2858 | 3822 | 1.30 | 2.32 | 115 | 155 |
| C. Ex. 5 | 4S5G | 7S7G | 0S1G | 1.7 | 2667 | 3849 | 1.30 | 1.63 | 135 | 155 |
| C. Ex. 6 | 4S5G | 7S7G | 0S1G | 1.5 | 2667 | 3849 | 1.30 | 1.63 | 125 | 155 |
| C. Ex. 7 | 4S5G | 7S7G | 0S1G | 1.5 | 2667 | 3822 | 1.30 | 2.32 | 125 | 155 |

Yarn properties are shown in Table 2B below.

TABLE 2B

Yarn Properties from the Spinning Conditions listed in Table 2A

| Ex. # | T4 g | DWS % | BOS % | Den | Mod g/d | Ten g/d | Elo % | % U % | T(p) C. | Tens(Tp) g/d | Ton C. |
|---|---|---|---|---|---|---|---|---|---|---|---|
| Ex. 4 | 6.5 | 0.8 | 8.7 | 91.4 | 22.3 | 3.48 | 51.7 | 0.87 | 176.4 | 0.188 | 63.3 |
| Ex. 1 | 6.2 | 0.6 | 9.7 | 91.1 | 22.2 | 3.60 | 47.6 | 0.94 | 169.7 | 0.230 | 61.9 |
| Ex. 6 | 5.0 | 1.1 | 10.3 | 91.9 | 23.1 | 3.63 | 46.0 | 0.94 | 171.2 | 0.252 | 61.4 |
| Ex. 5 | 6.0 | 0.7 | 9.7 | 91.7 | 22.9 | 3.46 | 46.3 | 0.89 | 175.2 | 0.195 | 64.0 |
| Ex. 3 | 6.3 | 0.9 | 9.9 | 91.7 | 22.6 | 3.53 | 47.4 | 0.93 | 171.0 | 0.234 | 61.7 |
| Ex. 7 | 5.2 | 1.3 | 9.6 | 91.9 | 22.8 | 3.40 | 45.9 | 0.86 | 168.2 | 0.261 | 60.2 |
| C. Ex. 5 | — | DR too high, difficult to string up | | | | | | | | | |
| C. Ex. 6 | 21.9 | Many spinning breaks and winding tension is too high. | | | | | | | | | |
| C. Ex. 7 | 19.0 | Many breaks. Winding tension was unable to be reduced to a reasonable value with windup overfeed being increased, compared to 82Ch3. DR is still too high. | | | | | | | | | |

The significant change in shrinkage properties such as DWS, BOS, peak tension, and peak temperature indicates that the draw ratio has an important influence on the tube crush winding. Draw ratios of 1.2, 1.3, and 1.4 were applied in Ex.4, Ex.1 and Ex.6 at a first godet temperature of 90° C. and other conditions given in Table 2A. When the draw ratio was increased in Exs.4, 1 and 6, the elongation was reduced breaks in C.Ex.6 and C.Ex.7, and the winding tension was too high.

Comparative Examples 8-13

Theses examples examine the effect of the number of turns wound on Godet-1 on threadline stability and optimum yarn uniformity represented by U %.

TABLE 3A

| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. |
|---|---|---|---|---|---|---|---|---|---|---|
| | Spinning Conditions for the Effect of Turns of Threadlines on the First Godet | | | | | | | | | |
| C. Ex. 8 | 4S5G | 6S6G | 3S4G | 1.3 | 3077 | 3849 | 1.3 | 1.63 | 115 | 125 |
| C. Ex. 9 | 5S6G | 6S6G | 3S4G | 1.3 | 3077 | 3849 | 1.3 | 1.63 | 115 | 125 |
| C. Ex. 10 | 6S7G | 6S6G | 3S4G | 1.3 | 3077 | 3849 | 1.3 | 1.63 | 115 | 125 |
| C. Ex. 11 | 4S5G | 6S6G | 3S4G | 1.3 | 3077 | 3849 | 1.3 | 1.63 | 135 | 125 |
| C. Ex. 12 | 5S6G | 6S6G | 3S4G | 1.3 | 3077 | 3849 | 1.3 | 1.63 | 135 | 125 |
| C. Ex. 13 | 6S7G | 6S6G | 3S4G | 1.3 | 3077 | 3849 | 1.3 | 1.63 | 135 | 125 |

TABLE 3B

| Ex. # | T4 g | DWS % | BOS % | Den | Mod g/d | Ten g/d | Elo % | % U % | Threadline Stability on Godet-1 |
|---|---|---|---|---|---|---|---|---|---|
| | Yarn Properties from the Spinning Conditions listed in Table 3A | | | | | | | | |
| C. Ex. 8 | 7.4 | — | 13.2 | 91.3 | — | 3.46 | 49.9 | 0.81 | Stable |
| C. Ex. 9 | 8.0 | — | 13.8 | 91.4 | — | 3.40 | 47.0 | 0.75 | Stable |
| C. Ex. 10 | 7.3 | — | 14.5 | 91.6 | — | 3.27 | 47.3 | 0.84 | Less stable |
| C. Ex. 11 | 7.7 | — | 14.2 | 91.4 | — | 3.32 | 46.1 | 0.74 | Stable |
| C. Ex. 12 | 8.0 | — | 14.7 | 91.5 | — | 3.36 | 47.3 | 0.86 | Stable |
| C. Ex. 13 | 8.6 | — | 15.0 | 91.6 | — | 3.32 | 47.0 | 1.07 | Less stable |

In C.Ex.8, 9 and 10, the number of turns was varied from 4S5G (4 half turns on the separator roll and 5 half turns on the godet) to 6S7G. It was observed that the 6S7G gave a less stable threadline on the first godet than 4S5G or 5S6G, and the U % tended to be higher. Similar results were seen in comparing C.Exs.11, 12 and 13. It is clear that to have a better spinning performance, 4S5G or 5S6G was a preferred number of turns for the threadline on the first godet.

In order to have better control the winding tension and reduce the slippage of the threadline on the third godet, the number of turns on the third godet was examined in Examples 3 and 8. Table 4A gives the spinning and Table 4B gives the yarn property conditions for the two examples.

TABLE 4A

| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. |
|---|---|---|---|---|---|---|---|---|---|---|
| | Spinning Conditions for the Effect of Turns of Threadlines on Third Godet | | | | | | | | | |
| Ex. 3 | 4S5G | 7S7G | 3S4G | 1.3 | 3077 | 3822 | 1.30 | 2.32 | 115 | 155 |
| Ex. 8 | 4S5G | 7S7G | 0S1G | 1.3 | 3077 | 3822 | 1.30 | 2.32 | 115 | 155 |

TABLE 4B

| Ex. # | T4 g | DWS % | BOS % | Den | Mod g/d | Ten g/d | Elo % | % U % | T(p) C. | Tens(Tp) g/d | Ton C. |
|---|---|---|---|---|---|---|---|---|---|---|---|
| | Yarn Properties Obtained from Spinning Conditions Listed in Table 4A | | | | | | | | | | |
| Ex. 3 | 6.3 | 0.9 | 9.9 | 91.7 | 22.6 | 3.53 | 47.4 | 0.93 | 171.0 | 0.234 | 61.7 |
| Ex. 8 | 14.1 | 1.2 | 9.1 | 92.1 | 21.1 | 3.56 | 48.7 | 0.89 | 170.0 | 0.232 | 61.8 |

From Table 4B it can be seen that, when the turns on the third godet reduced from 3S4G to 0S1G, the winding tension increased from 6.3 grams to 14.1 grams, with no change in other properties. This winding tension difference because of the difference in turns on third godet indicates that, with less turns on the third godet, more threadline slippage occurs on the third godet. Therefore, the actual overfeed between the winder and third godet is reduced, although no speed setting change was made between Ex.3 and Ex.8.

In the following examples, the occurrence of tube crush winding was determined based on a package size of about 2.4 kg in weight excluding the tube core, and a package diameter of about 158 mm. Tube crush winding is listed as occurring if one of the following things are observed:

(1) Packages of at least that size are stuck on the spindle and can not be removed, or (2) Packages of at least that size can be removed from the spindle, but crush lines can be found on the inside wall of the tube core.

Example 9, and Comparative Examples 17-18

The spinning conditions of these examples are given in Table 5A and the properties of the yarns produced in these examples are given in Table 5B. To achieve a proper winding tension for each of these examples, the windup overfeed was adjusted and given in Table 5A. As shown in Tables 5A and 5B, tube crush winding occurred when the third godet overfed at 0 and 0.7% among the three examples. As shown in Table 5B, increase in the third godet overfeed decreases the DWS or shrinkage at 70° C., reduces shrinkage peak tension, and increases shrinkage onset temperature.

TABLE 5A

| | Spinning Conditions | | | | | | | | | |
|---|---|---|---|---|---|---|---|---|---|---|
| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. |
| C. Ex. 17 | 4S5G | 7S7G | 3S4G | 1.2 | 3334 | 3901 | 0.00 | 1.410 | 115 | 165 |
| C. Ex. 18 | 4S5G | 7S7G | 3S4G | 1.2 | 3334 | 3872 | 0.70 | 1.450 | 115 | 165 |
| Ex. 9 | 4S5G | 7S7G | 3S4G | 1.2 | 3334 | 3828 | 1.70 | 1.566 | 115 | 165 |

TABLE 5B

| | Yarn properties for the examples given in Table 5A | | | | | | | | | | | | | |
|---|---|---|---|---|---|---|---|---|---|---|---|---|---|---|
| Ex. # | T4 g | DWS % | BOS % | Den | Mod g/d | Ten g/d | Elo % | % U % | Shr(70) % | Tens(Tp) g/d | Ton C. | Tp C. | TS(110) g/(d * C.) | Crush Wind. |
| C. Ex. 17 | 7.7 | 1.4 | 10.8 | 90.1 | 24.3 | 3.59 | 52.1 | 0.82 | 1.04 | 0.235 | 61.5 | 165.4 | 1.12E−03 | Yes |
| C. Ex. 18 | 6.2 | 1.0 | 10.1 | 90.5 | 23.9 | 3.52 | 52.8 | 0.81 | 1.05 | 0.217 | 63.4 | 170.0 | 1.22E−03 | Yes |
| Ex. 9 | 5.5 | 0.9 | 8.9 | 91.6 | 23.2 | 3.72 | 59.6 | 0.76 | 0.32 | 0.190 | 65.2 | 184.8 | 1.40E−03 | No |

Examples 9-12 and Comparative Example 16

Examples 9-12 and Comparative Example 16 demonstrate the effect of the second godet temperature on the tube crush winding. These examples demonstrate winding large size packages under spinning conditions that will not give tube crush winding. The third godet overfeed was set at 1.70% when the second godet temperature was varied. Four examples of package winding are given as listed in Table 6A, with other conditions the same as for Ex.1. As a comparison, the spinning condition for C.Ex.16 is also given in Table 6A. The yarn properties of the examples of package winding are given in Table 6B.

TABLE 6A

| | Spinning Conditions For The Examples Of Package Winding | | | | | | | | | |
|---|---|---|---|---|---|---|---|---|---|---|
| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. |
| C. Ex. 16 | 4S5G | 7S7G | 3S4G | 1.2 | 3334 | 3828 | 1.70 | 1.570 | 115 | 120 |
| Ex. 11 | 4S5G | 7S7G | 3S4G | 1.2 | 3334 | 3828 | 1.70 | 1.566 | 115 | 145 |
| Ex. 9 | 4S5G | 7S7G | 3S4G | 1.2 | 3334 | 3828 | 1.70 | 1.566 | 115 | 165 |
| Ex. 12 | 4S5G | 7S7G | 3S4G | 1.2 | 3334 | 3828 | 1.70 | 1.566 | 115 | 185 |
| Ex. 10 | 4S5G | 7S7G | 3S4G | 1.2 | 3334 | 3829 | 1.70 | 1.560 | 115 | 195 |

TABLE 6B

Yarn properties of the spinning conditions listed in Table 6A

| Ex. # | T4 g | DWS % | BOS % | Den | Mod g/d | Ten g/d | Elo % | % U % | Shr(70) % | Tens(Tp) g/d | Ton C. | Tp C. | TS(110) g/(d * C.) | Crush Wind. |
|---|---|---|---|---|---|---|---|---|---|---|---|---|---|---|
| C. Ex. 16 | 6.4 | 1.4 | 11.5 | 91.0 | 23.6 | 3.66 | 58.0 | 0.80 | 1.93 | 0.211 | 61.0 | 166.5 | 8.85E−04 | Yes |
| Ex. 11 | 5.8 | 0.9 | 10.5 | 91.5 | 23.3 | 3.67 | 58.7 | 0.84 | 1.03 | 0.196 | 64.4 | 175.2 | 1.12E−03 | No |
| Ex. 9 | 5.5 | 0.9 | 8.9 | 91.6 | 23.2 | 3.72 | 59.6 | 0.76 | 0.32 | 0.190 | 65.2 | 184.8 | 1.40E−03 | No |
| Ex. 12 | 5.8 | 0.4 | 9.2 | 91.6 | 23.1 | 3.64 | 56.8 | 0.96 | 0.14 | 0.188 | 67.0 | 188.3 | 1.41E−03 | No |
| Ex. 10 | 6.4 | 0.9 | 7.5 | 90.6 | 23.8 | 3.63 | 57.0 | 0.72 | 0.57 | 0.177 | 63.6 | 191.8 | 6.45E−04 | No |

In Tables 6A and 6B tube crush winding was avoided at godet temperatures above 120° C., and temperatures between about 145° C. and 195° C. were satisfactory in combination with a third godet overfeed of about 1.7%, a windup overfeed of about 1.56%, and the other properties specified in the previous examples and tables.

When a higher temperature is used at the second godet, the elongation and tenacity are basically maintained, but the peak tension is reduced and the peak tension temperature and shrinkage onset temperature are increased. At a given elongation and tenacity, the optimum second godet temperature is closely tied to the choice of a proper third godet overfeed

TABLE 6C

Description of package formation for the examples of package winding

| Ex. # | PKG Weight kg | PKG End Diameter mm | Bulge Ratio-1% | Bulge Ratio-2% | Dish ratio % |
|---|---|---|---|---|---|
| C. Ex. 16 | — | — | — | — | — |
| Ex. 11 | 16.49 | 322.8 | 5.14 | 6.11 | 0.50 |
| Ex. 9 | 16.43 | 323.7 | 4.15 | 4.91 | 0.86 |
| Ex. 12 | 13.62 | 295.4 | 4.74 | 6.47 | 0.63 |
| Ex. 10 | 9.99 | 259.4 | 3.77 | 6.36 | 0.25 |

Using conditions from Example 9 to Example 11, packages larger than conventional sized packages were made with low bulge and without tube crush winding.

Comparative Examples 21-26

Tube crush winding can result from too high a packaging temperature, even if the properties of the yarn are otherwise satisfactory. The following comparative examples show the effect of third godet temperatures. Comparative examples 21 to 25 were made by bypassing the second godet. The spinning conditions for Comparative Examples 21-26 are given in Table 7A and other conditions that are not covered by Table 7A are the same as these applied in Example 1. The properties of the resultant yarns obtained in these examples are given in Table 7B. The spinning condition and yarn properties of Example 11 are also given in Table 7A and 7B as a comparison.

TABLE 7A

Examples For Tube Crush Winding

| Ex. # | Turn(G1) turn | Turn(G2) turn | Turn(G3) turn | DR | SP(G1) m/m | SP(WU) m/m | OvFd(G3) % | OvFd(WU) % | T(G1) C. | T(G2) C. | T(G3) C. |
|---|---|---|---|---|---|---|---|---|---|---|---|
| C. Ex. 21 | 4S5G | — | 5S6G | 1.2 | 3334 | 3817 | 0.00 | 3.24 | 115 | — | 180 |
| C. Ex. 22 | 4S5G | — | 5S6G | 1.2 | 3334 | 3799 | 0.00 | 3.70 | 115 | — | 180 |
| C. Ex. 23 | 4S5G | — | 5S6G | 1.2 | 3334 | 3780 | 0.00 | 4.16 | 115 | — | 180 |
| C. Ex. 24 | 4S5G | — | 5S6G | 1.2 | 3334 | 3762 | 0.00 | 4.63 | 115 | — | 195 |
| C. Ex. 25 | 4S5G | — | 5S6G | 1.2 | 3334 | 3753 | 0.00 | 4.86 | 115 | — | 195 |
| C. Ex. 26 | 4S5G | 7S7G | 3S4G | 1.2 | 3334 | 3735 | 1.70 | 3.67 | 115 | 145 | 195 |
| Ex. 11 | 4S5G | 7S7G | 3S4G | 1.2 | 3334 | 3828 | 1.70 | 1.566 | 115 | 145 | m |

TABLE 7B

Yarn Properties For The Spinning Conditions Listed In Table

| Ex. # | T4 g | DWS % | BOS % | Den | Mod g/d | Ten g/d | Elo % | % U % | Shr(70) % | Tens(Tp) g/d | Ton C. | Tp C. | TS(110) g/(d * C.) | Crush Wind. |
|---|---|---|---|---|---|---|---|---|---|---|---|---|---|---|
| C. Ex. 21 | 10.4 | 1.15 | 7.7 | 90.9 | 23.7 | 3.67 | 58.1 | 0.92 | 0.95 | 0.180 | 59.7 | 187.5 | 4.83E−04 | Yes |
| C. Ex. 22 | 9.3 | 0.90 | 7.6 | 91.1 | 23.2 | 3.72 | 60.6 | 0.92 | 0.90 | 0.172 | 60.8 | 186.7 | 5.14E−04 | Yes |
| C. Ex. 23 | 7.6 | 0.90 | 6.8 | 91.4 | 22.9 | 3.62 | 59.0 | 0.92 | 0.75 | 0.176 | 58.2 | 189.1 | 2.25E−04 | Yes |
| C. Ex. 24 | — | 0.90 | 5.5 | 90.7 | 22.8 | 3.57 | 58.3 | 0.92 | 0.84 | 0.156 | 62.1 | 195.2 | 6.29E−05 | Yes |
| C. Ex. 25 | 7.5 | 0.80 | 5.0 | 92.0 | 22.4 | 3.57 | 59.3 | 0.84 | 0.64 | 0.147 | 62.7 | 199.6 | 2.47E−04 | Yes |
| C. Ex. 26 | 6.7 | 0.70 | 6.3 | 92.6 | 22.8 | 3.49 | 59.2 | 0.95 | 0.77 | 0.148 | 61.6 | 196.9 | 1.00E−06 | Yes |
| Ex. 11 | 5.8 | 0.9 | 10.5 | 91.5 | 23.3 | 3.67 | 58.7 | 0.84 | 1.03 | 0.196 | 64.4 | 175.2 | 1.12E−03 | No |

After it was wound onto a tube, the yarn stayed in a winding package. The temperature in the winding package remained elevated for sufficient time to further anneal the yarn before the package temperature reduced to room temperature. Because of this, the elevated temperature in a winding package increased the peak temperature, reduced peak tension and reduced DWS or BOS dramatically. The tube crush winding occurred because of this elevated temperature. Example 11, within the range of required inventive properties, had no tube crush winding.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the disclosure.

What is claimed is:

1. Poly(trimethyleneterephthalate) multifilament yarn having the following properties:

(a) shrinkage onset temperature of above 60° C., (b) a shrinkage at 70° C. of below 1.2%, (c) a peak thermal tension of below 0.2 g/d, and (d) a thermal tension slope at 110° C. greater than $5.20\times 10^{-04}$ [g/(d ° C.)].

2. The poly(trimethylene terephthalate) multifilament yarn of claim 1 having an elongation of about 30 to about 60%.

3. The poly(trimethylene terephthalate) multifilament yarn of claim 1 having an tenacity of at least about 3.0 g/d.

4. The yarn of claim 1, having a BOS of 6-14%.

5. The yarn of claim 1, having an Uster of 1.5% or less.

6. Fabric comprising the yarn of claim 1.

7. Carpet comprising the yarn of claim 1.

8. Upholstery comprising the yarn of claim 1.

9. The yarn of claim 1, having a thermal tension peak temperature (Tp) of about 140 to about 200° C.

10. A poly(trimethylene terephthalate) multifilament yarn of claim 1 wherein the filament IV is from about 0.7 to about 1.1.

11. A cheese-shaped package containing the multifilament yarn as claimed in claim 1.

12. The cheese-shaped package of claim 11 which does not crush upon standing for 96×hours after the yarn is wound on the package.

13. A cheese-shaped package of claim 11, containing at least 6 kg of poly(trimethylene terephthalate) multifilament yarn and having a bulge ratio of less than about 10%.

14. The cheese-shaped package of claim 11 containing at least 7 kg of poly(trimethylene terephthalate) multifilament yarn and having a bulge ratio of less than 10%, when the thickness of yarn layer is from above 49 millimeters to about 107 millimeters.

15. The cheese-shaped package of claim 11, having a package dish ratio of less than 2%.

16. The cheese-shaped package of claim 11 containing at least 7 kg of poly(trimethylene terephthalate) multifilament yarn and having a bulge ratio of less than 6%, when the thickness of yarn layer is from about 25 millimeters to 49 millimeters.

17. The cheese-shaped package of claim 11, containing 7 to about 25 kg of poly(trimethylene terephthalate) multifilament yarn.

18. The cheese-shaped package of claim 11, containing 7 to about 20 kg of poly(trimethylene terephthalate) multifilament yarn.

19. The cheese-shaped package of claim 11, having a bulge ratio of less than about 10%.

20. A cheese-shaped package of filament in claim 11 exhibiting no tube crush winding and made according to the process comprising:

(a) continuously spinning molten poly(trimethylene terephthalate) into solid filaments, (b) winding the solid filaments onto a first godet, wherein the temperature of the first godet is about 85° C. to about 160° C., (c) winding the filaments onto a second godet, (d) winding the filaments onto a third godet, and (e) winding the filaments onto a spindle on a winder to form a package, wherein the filaments are overfed onto the third godet and the winding tension between the third godet and the spindle is 0.04 to 0.12 gram per denier.

21. A poly(trimethylene terephthalate) multifilament yarn of claim 1 made by the process comprising:

(a) continuously spinning molten poly(trimethylene terephthalate) into solid filaments, (b) winding the solid filaments onto a first godet, wherein the temperature of the first godet is about 85° C. to about 160° C., (c) winding the filaments onto a second godet, (d) winding the filaments onto a third godet, and (e) winding the filaments onto a spindle on a winder to form a package, wherein the filaments are overfed onto the third godet and the winding tension between the third godet and the spindle is 0.04 to 0.12 gram per denier.

22. The yarn of claim 21, having a BOS of 6-14%.

23. The yarn of claim 21, having an elongation of 30-60%.

24. The yarn of claim 21, having a tenacity of at least 3.0 g/d.

25. The yarn of claim 21, having an Uster of 1.5% or less.

26. Fabric comprising the yarn of claim 21.

27. Carpet comprising the yarn of claim 21.

28. Upholstery comprising the yarn of claim 21.

29. The yarn of claim 1, having a denier of about 40 to about 300.

30. The yarn of claim 21, having a denier of about 40 to about 300.

* * * * *